United States Patent [19]

Nilssen

[11] Patent Number: 4,598,232

[45] Date of Patent: Jul. 1, 1986

[54] HIGH-FREQUENCY LIGHTING SYSTEM

[76] Inventor: Ole K. Nilssen, Caesar Dr., Barrington, Ill. 60010

[21] Appl. No.: 526,389

[22] Filed: Aug. 25, 1983

[51] Int. Cl.[4] ..... H05B 37/02; H05B 39/04; H05B 41/36

[52] U.S. Cl. ..... 315/225; 315/DIG. 5; 315/DIG. 7; 315/243; 361/88; 338/20

[58] Field of Search ..... 315/DIG. 5, DIG. 7, 315/225, 243; 361/88, 89; 338/20

[56] References Cited

U.S. PATENT DOCUMENTS

| | | | |
|---|---|---|---|
| 3,389,216 | 6/1968 | Sennik | 338/20 X |
| 3,896,336 | 7/1975 | Schreiner et al. | 315/DIG. 7 |
| 3,991,340 | 11/1976 | Ichinose et al. | 338/20 X |
| 4,210,846 | 7/1980 | Capewell et al. | 315/DIG. 4 |
| 4,392,087 | 7/1983 | Zansky | 315/291 |
| 4,437,042 | 3/1984 | Morais et al. | 315/DIG. 5 |
| 4,461,980 | 7/1984 | Nilssen | 315/DIG. 7 |

*Primary Examiner*—Saxfield Chatmon

[57] ABSTRACT

Subject high-frequency lighting system comprises the following principal component parts:

(a) a power-line-operated power supply operable to supply a high-frequency (30 kHz) output voltage;

(b) a plurality of lighting fixtures—with each such fixture comprising one or more gas discharge lamps and series-resonant ballasting means operative to derive the requisite lamp operating voltages and currents from the power supply's high-frequency voltage output; and (c) a bus wire means operative to distribute said high-frequency voltage from the power supply and to each of the fixtures. To protect against circuit failures, which might occur due to excessive socket voltages resulting upon removal of a lamp or toward end-of-lamp-life, a Varistor voltage-limiting means and a self-latching circuit breaker means are used with each series-resonant ballast. The Varistor saves the circuit from immediate self-destruction in case of lamp failure or non-presence; and the circuit breaker serves to decouple the circuit from its high-frequency voltage supply whenever the circuit has been without proper lamp loading for longer than about two seconds.

10 Claims, 2 Drawing Figures

HIGH-FREQUENCY LIGHTING SYSTEM

BACKGROUND OF THE INVENTION

1. Field of the Invention

The present invention relates to lighting systems wherein power to a plurality of lighting fixtures is provided from a central high-frequency voltage source.

2. Description of Prior Art

Lighting systems wherein a plurality of lighting fixtures are powered from a single central source of high-frequency voltage have been described in prior patents. For instance, such systems are described in U.S. Pat. No. 3,710,177 to Richard Ward and in U.S. Pat. No. 4,207,498 to Joel S. Spira.

In such a system, one of the most efficient and cost-effective ways of ballasting a gas discharge lamp from the central source of high-frequency voltage is by way of a series-resonant circuit; that is, by connecting the series-resonant circuit across the high-frequency voltage supply while connecting the lamp load in parallel with one of the reactive elements (typically the capacitor) of the series-resonant circuit.

However, there is an important problem associated with such a series-resonant ballasting method; namely, with the lamp load removed, the current drawn by the then unloaded series-resonant circuit gets to be so high as to cause destruction of the circuit itself and/or of the high-frequency voltage source.

This problem has been partly recognized, and—in the case of four-terminal fluorescent lamps—a partial solution has been described by Ward and others, a solution wherein the series-resonant circuit is automatically disconnected from the high-frequency voltage source by removing the lamp from even one of its socket terminals.

However, it is apparently not recognized that the lamp load may in effect be removed even if the lamp remains in its socket. In particular, this type of situation is apt to occur toward end of lamp life: the cathodes may then still be intact in the sense of being capable of conducting current, but the lamp may fail to start; which implies that the series-resonant circuit is still connected across the high-frequency voltage source, but the circuit loading is effectively non-present. Thus, toward end of lamp life, a potentially destructive mode of operation is apt to result.

Moreover, the partial solution described by Ward and others, is non-applicable to situations where two-terminal gas discharge lamps are used.

SUMMARY OF THE INVENTION

Objects of the Invention

A first object of the present invention is that of providing a cost-effective high-efficiency lighting system.

A second object is that of providing a power-line-operated high-frequency lighting system that is adapted for use with gas discharge lamps by way of simple and fail-safe ballasting means.

A third object is that of providing a power-line-operated high-frequency fluorescent lighting system that is adapted to be safely used with series-resonant ballasting means.

These as well as other objects, features and advantages of the present invention will become apparent from the following description and claims.

Brief Description

In its preferred embodiment, subject invention constitutes a high-frequency lighting system comprising the following principal component parts.

(a) a power-line-operated power supply operable to supply an output of substantially constant magnitude voltage of frequency on the order of 30 kHz;

(b) a plurality of lighting fixtures—with each such fixture comprising one or more gas discharge lamps and series-resonant ballasting means operative to derive the requisite lamp operating voltages and currents from the power supply's high-frequency output voltage; and (c) a means to distribute the high-frequency voltage from the power supply to each of the fixtures.

To protect against circuit failures, which might occur due to excessive lamp socket voltages resulting upon removal of a lamp from its socket or toward end-of-lamp-life, a Varistor voltage-limiting means and a self-latching circuit breaker means are used with each series-resonant ballast. The Varistor saves the circuit from immediate self-destruction in case of lamp failure or non-presence, and the circuit breaker serves to decouple the circuit from its high-frequency voltage supply whenever the circuit has remained without a proper lamp load for longer than about two seconds.

In addition to having lighting fixtures with gas discharge lamps, the system is anticipated as well to have fixtures for incandescent lamps, particularly low-voltage incandescent lamps; which, due to the high-frequency supply voltage, can be powered by way of small and inexpensive high-frequency transformers.

To provide added flexibility, the RMS magnitude of the high-frequency voltage is made to be 120 Volt, which therefore permits the direct use of ordinary incandescent lamps with subject lighting system.

DESCRIPTION OF THE PREFERRED EMBODIMENT

Details of System and Circuits

Figure 1:
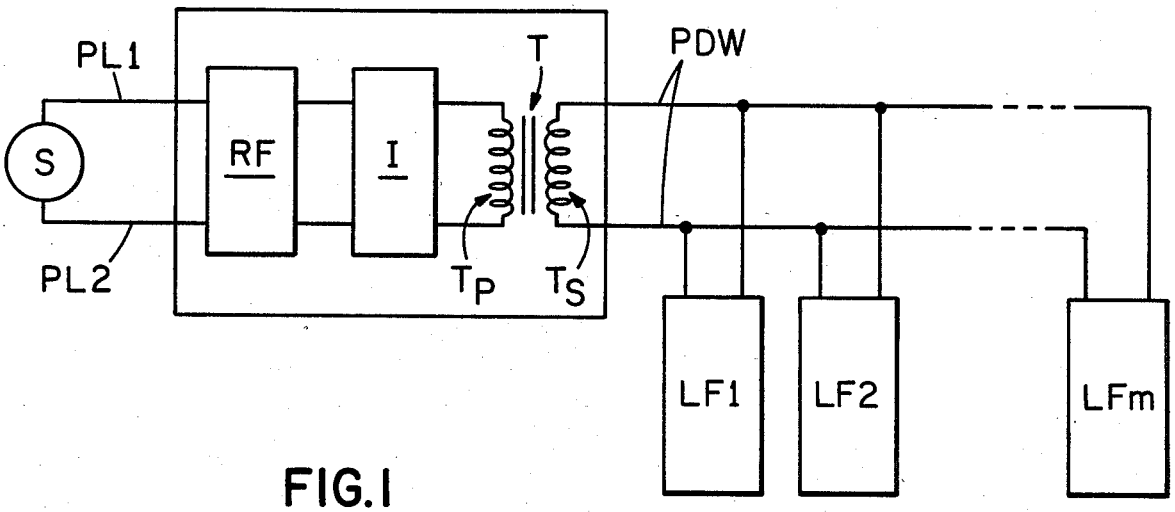
FIG. 1 provides a schematic overview of the invention and shows a power-line-operated inverter power supply feeding a pair of distribution wires with a high-frequency voltage for operation of a plurality of individual lighting fixtures.

In FIG. 1, a source S of 120 Volt/60 Hz voltage is applied by way of power line conductors PL1 and PL2 to inverter power supply PS, the output of which is connected to a pair of power distribution wires PDW. Along these power distribution wires and connected thereto are a number n of lighting fixtures LF1, LF2–LFn.

Inside PS, power line conductors PL1 and PL2 are directly connected with a rectifier-filter combination RF, the substantially constant DC output voltage of which is applied to an inverter I. The output from inverter I is a 30 kHz AC voltage, which voltage is applied to the primary winding Tp of transformer T. The output of transformer T is provided directly to the power distribution wires PDW from its secondary winding Ts and is a 30 kHz AC voltage of 120 Volt RMS magnitude.

Figure 2:
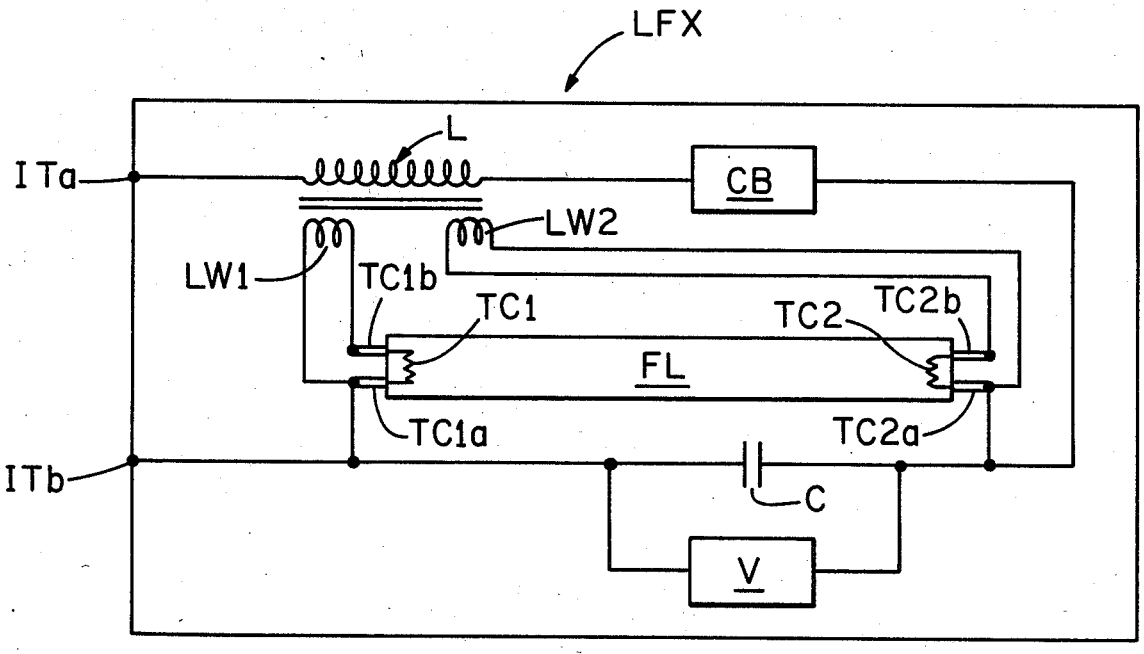
FIG. 2 schematically illustrates electrical circuit details of an individual fluorescent lighting fixture with its series-resonant ballasting means.

FIG. 2 illustrates one of the n lighting fixtures referred to in FIG. 1 as LF1, LF2–LFn. This one lighting fixture is referred to as LFx. It has a pair of power input terminals ITa and ITb, and comprises a fluorescent lamps FL, a ballasting inductor L, a thermally responsive latching circuit breaker CB, a ballasting capacitor C, and a Varistor V.

Inductor L has two secondary windings LW1 and LW2; and fluorescent lamp FL has two thermionic cathodes TC1 and TC2, each having a pair of cathode terminals: TC1*a* and TC2*a* and TC2*b* respectively. Winding LW1 is connected with cathode TC1, and winding LW2 is connected with cathode TC2.

Inductor L, circuit breaker CB, and capacitor C are all connected in series across input terminals ITa and ITb.

The fluorescent lamp is connected in parallel across the capacitor by way of cathode terminals TC1*a* and TC2*a*.

The voltage limiting Varistor V is also connected in parallel across the capacitor.

Description of Operation

The operation of the subject high-frequency lighting system may be explained as follows.

In FIG. 1, the pair of power line conductors PL1 and PL2 provides 120 Volt/60 Hz power to the power supply PS; which, by way of rectifier-and-filter means RF and inverter I, converts this 120 Volt/60 Hz input voltage to a 30 kHz output voltage. This high-frequency output voltage is transformed by transformer T to a magnitude of about 120 Volt RMS and is supplied to the power distribution wires PDW for distritution to a number n of lighting fixtures LF1, LF2–LFn. These lighting fixtures may contain one or more of different types of lamps: incandescent lamps (low-voltage and/or high-voltage versions) and/or gas discharge lamps (fluorescent lamps and/or H.I.D. lamps).

In FIG. 2, inductor L and capacitor C are both high-Q components and are substantially resonant with one another at the fundamental frequency of the high-frequency voltage. Thus, the L-C series combination constitutes a high-Q series-resonant circuit powered by a voltage source; which implies that the voltage developed across C (or L) will be much larger than the voltage supplied from the source. In fact, the voltage across C will be magnified by the so-called Q-multiplication factor.

Hence, when the lamp is disconnected from the circuit (or before the lamp has ignited), the voltage across C will be limited by the non-linear loading of Varistor V. The voltage limiting characteristics of this Varistor have been so chosen as to permit the voltage across C to reach a magnitude that is suitable for effective lamp starting.

After the lamp has ignited, the lamp itself will provide for voltage limitation at a voltage of magnitude lower than that which causes conduction by the Varistor; which implies that, when the lamp is operating, the Varistor is in substance disconnected from the circuit.

During the normally brief period before the lamp ignites, the magnitude of the current drawn by the series-resonant circuit will be relatively high. It will in fact be proportional to the magnitude of the voltage present across C (or L); which implies that it will normally be about twice as high before the lamp ignites as compared with the situation after the lamp has reached its normal operating state.

The thermally resonsive normally-closed circuit breaker CB will open (and latch itself in the open state) if the current flowing into the series-resonant circuit remains above the normal operating level for longer than a few seconds. In particular, if the magnitude of the current drawn through the circuit breaker is about twice the magnitude of the normal circuit operating current, the circuit breaker will open within a time period of less than about two seconds—two seconds definitely being an adequate amount of time for the lamp to ignite under any kind of normal circumstances.

However, the circuit breaker will not open if the magnitude of the current flowing through it falls to its normal operating level within two seconds after activating the circuit.

Thus, as long as the lamp ignites within about two seconds, the circuit breaker will not open; and the lamp will be powered as if the circuit breaker were not present.

Of course, if the lamp fails to start, or if the lamp is removed, the circuit breaker will open within the indicated brief period of time.

In other words, while the Varistor serves two functions: (i) protection of the circuit from instant destruction in case the lamp is non-present or inoperative, and (ii) provision of proper lamp starting voltage; the circuit breaker serves the function of limiting the total amount of power dissipated in the Varistor.

The Varistor should be rated such as to be able to absorb the amount of power dissipated in it during the two seconds or so before the lamp starts or before the circuit breaker opens. For a typical F40/T12/RS fluorescent lamp, where the lamp operating voltage is about 100 Volt RMS and where the lamp starting voltage is about 200 Volt RMS, the Varistor has to be able to absorb about 80 Watt of power for up to two seconds; which amounts to about 160 Joule.

The secondary windings on the inductor L serve the purpose of providing low-voltage heating power for the fluorescent lamp cathodes. During the initial period before the lamp starts, when the voltage across L is relatively high, the voltage provided to the cathodes is also relatively high. After the lamp has ignited, the voltage across L reduces; and the voltage provided to the cathodes reduces correspondingly. In the preferred embodiment, for maximum efficiency, the cathode heating voltage normally required for Rapid-Start operation is provided during the lamp starting period (i.e., before the lamp ignites); which implies that the cathode heating voltage supplied after the lamp has ignited is only about half the normal amount—with corresponding savings in cathode heating power.

It is noted that a thermally responsive normally-open circuit breaker is a well known entity typically consisting of a bi-stable bi-metallic bender that is heated by a relatively low-resistance-value resistor connected in series with the circuit breaker. If the magnitude of the current flowing through the circuit breaker exceeds a certain design limit for a specified period of time, the amount of heat resulting is adequate to cause the bi-stable bi-metallic bender to click open; which then breaks the flow of current to the circuit. However, to provide for a latching effect, a relatively high-resistance-value resistor is connected across the circuit breaker's contacts; which implies that—after the circuit breaker has opened—heating will be provided so as to keep the contacts open until power is removed from the fixture's power input terminals.

It is also noted that—instead of providing cathode heating by way of secondary wndings on inductor L—cathode heating could have been provided by way of connecting the tank capacitor C between inductor L and input terminal IT2 by way of the two lamp cathodes—in the manner described by Ward in U.S. Pat. No. 3,710,177.

It is believed that the present invention and its several attendant advantages and features will be understood from the preceeding description. However, without departing from the spirit of the invention, changes may be made in its form and in the construction and interrelationships of its component parts, the form herein presented merely representing the preferred embodiment.

I claim:

1. A lighting fixture adapted to be powered from a source of AC voltage, said AC voltage being of frequency substantially higher than that of the voltage on an ordinary electric utility power line comprising:

a pair of input terminals operable to connect with said source of AC voltage;

a series-combination of an inductor and a capacitor, said series-combination being: (i) connected in circuit between said pair of input terminals, (ii) substantially resonant at the fundamental frequency of said AC voltage, and (iii) whenever not connected with an adequate load, disposed to draw an excessively large amount of current from said input terminals whenever said AC voltage is present thereacross;

a gas discharge lamp disconnectably connected in circuit either across said capacitor or across said inductor, whereby, whenever connected and in operation, said lamp constitutes an adequate load for said resonant series-combination, thereby preventing said excessively large amount of current from being drawn;

protection means connected in circuit with said resonant series-combination and operative to prevent, whenever said lamp is disconnected or otherwise fails to constitute an adequate load, said excessively large amount of current from being drawn; and mechanical structure means operative to support and hold together said input terminals, said gas discharge lamp, said series-combination, and said protection means.

2. The lighting fixture of claim 1 wherein said protection means comprises a non-linear impedance means operative to provide an alternative load means for said resonant series-combination in the event that the lamp is disconnected or fails to operate, thereby preventing said resonant series-combination from drawing said excessively large amount of current.

3. The lighting fixture of claim 1 wherein said protection means comprises a switch means that is: (i) actuated upon disconnection or operational failure of the lamp, and (ii) operative, whenever actuated, to prevent said series-combination from drawing said excessively large amount of current.

4. The lighting fixture of claim 1 wherein said gas discharge lamp comprises thermionic cathodes and wherein said inductor comprises auxiliary windings operative to provide low-voltage heating power for said cathodes.

5. A lighting system comprising:

a source of AC voltage, said source being disposed to become inoperative in the event of being called upon for more than a brief period of time to supply an excessively large amount of current;

power distribution means connected with said source of AC voltage and operative to distribute said AC voltage to a number of different locations, each such location providing said AC voltage across a pair of power output terminals; and a plurality of series-resonant-loaded lighting fixtures, each such lighting fixture comprising:

(a) a pair of input terminals operable to connect with a pair of said output terminals at one of said locations;

(b) a series-combination of an inductor and a capacitor, said series-combination being: (i) connected in circuit between said pair of input terminals, (ii) substantially resonant at the fundamental frequency of said AC voltage, and (iii) whenever not connected with an adequate load, disposed to draw an excessively large amount of current from said input terminals whenever said AC voltage is present thereacross;

(c) a gas discharge lamp disconnectably connected in circuit either across said capacitor or across said inductor, whereby, whenever connected and in operation, said lamp constitutes an adequate load for said resonant series-combination, thereby preventing said excessively large amount of current from being drawn;

(d) prevention means connected in circuit with said series-combination and operative to prevent, whenever said lamp is disconnected or otherwise fails to constitute an adequate load, said excessively large amount of current from being drawn; and (e) mechanical structure means operative to support and hold together said input terminals, said gas discharge lamp, said series-combination, and said prevention means;

whereby said source of AC voltage is prevented from becoming inoperative as the result of the removal and/or failure of one or more lamps in the lighting system;

thereby, in the event of removal and/or failure of one or more lamps in one or more of said series-resonant-loaded fixtures, the remaining fixtures will continue to function.

6. A lighting system adapted to be powered from an ordinary electric utility power line and comprising:

a central frequency converter means connected with said power line and operative to provide a central output of high-frequency AC voltage, said frequency converter means being disposed to become inoperative in case of being called upon for more than a brief period of time to supply an excessively large amount of current, said AC voltage being of a frequency that is substantially higher than that of the voltage on said power line;

a distribution means connected with said central output and operative to distribute said AC voltage to a number of different locations, each such location having a pair of output terminals across which said AC voltage is provided;

a plurality of series-resonant-loaded lighting units, each such lighting unit comprising:

(a) a pair of fixture input terminals operable to connect with a pair of said output terminals at one of said locations;

(b) a series-combination of an inductor and a capacitor. said series-combination being: (i) connected in circuit between said pair of input terminals, (ii) substantially resonant at the fundamental frequency of said AC voltage, and (iii) whenever not connected with an adequate load, disposed to drawing an excessively large amount of current from said input terminals whenever said AC voltage is present thereacross;

(c) a gas discharge lamp disconnectably connected in circuit either across said capacitor or across said inductor, whereby, whenever connected and in operation, said lamp constitutes an adequate load for said resonant series-combination, thereby preventing said series-combination from drawing said excessively large amount of current;

(d) means to prevent, whenever said lamp is disconnected or otherwise fails to constitute an adequate load, said resonant series-combination from drawing said excessively large amount of current from said input terminals; and (e) mechanical structure means operative to support and hold together said input terminals, said gas discharge lamp, said series-combination, and said protection means;

whereby said central frequency converter means is prevented from becoming inoperative as the result of the removal and/or failure of one or more lamps in the lighting system;

thereby, in the event of lamp removal from and/or lamp failure in one or more of said series-resonant-loaded lighting units, the remaining lighting units will remain in operation.

7. A lighting system adapted to be powered from an ordinary electric utility power line and comprising:

central frequency converter means connected with said power line and operative to provide a central output of high-frequency AC voltage, said AC voltage being of frequency substantially higher than that of the voltage on said power line;

distribution means connected with said central output and operative to distribute said AC voltage to a number of different locations, each such location having output terminal means at which said AC voltage is provided; and a plurality of lighting units, each lighting unit having input terminal means for connection with the output terminal means at one of said locations, at least one of said lighting units having:

(i) a gas discharge lamp, and (ii) a series-combination of an inductor and a capacitor connected between said input terminals; with said series-combination being substantially series-resonant at the fundamental frequency of said AC voltage; with said gas discharge lamp disconnectably connected in circuit across said inductor or said capacitor; with said gas discharge lamp, when connected and operative, constituting a load for said series-resonant series-combination, thereby preventing the magnitude of the voltage across either the inductor or the capacitor from becoming destructively high; said series-combination having a power dissipated circuit protection means non-disconnectably connected in circuit therewith; with said circuit protection means being operative to prevent, in case of removal or non-operation of said gas discharge lamp, the magnitude of the voltage across said inductor or said capacitor from becoming destructively high.

8. A lighting fixture adapted to be powered from a source of AC voltage, said AC voltage being of frequency substantially higher than that of the voltage on an ordinary electric utility power line, said lighting fixture comprising:

a pair of input terminals operative to connect with said sources of AC voltage;

a gas discharge lamp; and a series-combination of an inductor and a capacitor connected between said input terminals; with said series-combination being substantially series-resonant at the fundamental frequency of said AC voltage; with said gas discharge lamp disconnectably connected in circuit across said inductor or said capacitor; with said gas discharge lamp, when connected and operative, constituting a load for said series-resonant series-combination, thereby preventing the magnitude of the voltage across either the inductor or the capacitor from becoming destructively high; said series-combination having a power dissipated circuit protection means non-disconnectably connected in circuit therewith; with said circuit protection means being operative to prevent, in case of removal or non-operation of said gas discharge lamp, the magnitude of the voltage across said inductor or said capacitor from becoming destructively high.

9. The lighting fixture of claim 8 wherein said circuit protection means comprises a non-linear impedance means.

10. The lighting fixture of claim 8 wherein the fundamental frequency of said AC voltage is on the order of 30 kHz.

* * * * *